United States Patent [19]

Feather

[11] 4,073,490

[45] Feb. 14, 1978

[54] BODY ATTACHED RESTRAINING TYPE EXERCISING DEVICE

[76] Inventor: Jack Vincent Feather, P.O. Box 737, Pebble Beach, Calif. 93953

[21] Appl. No.: 692,900

[22] Filed: June 4, 1976

[51] Int. Cl.[2] ..... A63B 21/04

[52] U.S. Cl. ..... 272/136; 272/142; 272/70; 128/293

[58] Field of Search ..... 272/136, 135, 142, 143, 272/116, 119, 93, 99, 70, 139; 273/188 R, 189 R, 193 A; 2/311, 315, 316, 308; 128/293

[56] References Cited

U.S. PATENT DOCUMENTS

| | | | |
|---|---|---|---|
| 475,432 | 5/1892 | Blades | 273/189 R |
| 1,703,375 | 2/1929 | Volk | 273/188 R |
| 2,498,006 | 2/1950 | Ridill | 273/189 R |
| 3,193,288 | 7/1965 | Le Vell De Spain et al. | 272/136 |
| 3,458,188 | 7/1969 | Infante | 272/142 X |
| 3,588,105 | 6/1971 | Donohue | 272/119 X |
| 3,937,465 | 2/1976 | Roland | 273/188 R X |

FOREIGN PATENT DOCUMENTS

| | | | |
|---|---|---|---|
| 436,348 | 10/1926 | Germany | 272/136 |

*Primary Examiner*—Richard C. Pinkham
*Assistant Examiner*—William R. Browne
*Attorney, Agent, or Firm*—Bruce & McCoy

[57] ABSTRACT

An improved exercising device comprised of a body support belt having an inner, relatively wide, and rubber-like body engaging band and an outer substantially inelastic reinforcement material, and further comprised of a relatively wide rubber-like wrap band secured to and extending substantially beyond the body support belt, and an elastic cord member attached to the ends of the body support belt which can be releasably hooked to a doorknob or the like whereby, when a user wearing the body support belt and wrap band jogs in place against the tension of the elastic cord member, the rubber-like body engaging band and wrap band evenly distribute pressure over the contacted portion of the body and insulate the user's midsection to induce sweating.

5 Claims, 4 Drawing Figures

BODY ATTACHED RESTRAINING TYPE EXERCISING DEVICE

BACKGROUND OF THE INVENTION

1. Field Of The Invention

The present invention relates to physical conditioning devices and more particularly to an improved portable exercising device which attaches to a doorknob or the like to allow the user to jog in place against the tension of a stretched elastic cord member.

2. Description Of The Prior Art

There are generally known physical conditioning devices utilized for jogging or running in place against the tension of restraining elastic cord members. A prior art patent discloses a jogging belt comprised essentially of a strap capable of being fitted around the use's waist and an elastic cord secured to each end of the strap; a clamp member capable of engaging a hook secured to a wall is secured to and joins the remote ends of the cords. The prior art jogging device is used in the conventional manner in that the user wearing the strap around his waist exerts himself by running outwardly against the tension generated in the stretched elastic cords. The more the elastic cords are stretched the more resistance that is encountered.

The problem with this prior art device is that the single ply strap which engages the body is necessarily made from a relatively durable and inelastic material which tends to localize or concentrate contact forces at the body's midsection thereby causing pressure points or a pinching effect. This problem is aggravated partly due to the fact that the strap only contact approximately half the circumference of the user's midsection. In addition to pinching by the strap and the discomfortature and even injury caused thereby, the strap disclosed by the prior art device could also cause discomfort and some possible skin abrasion by slipping on the user's skin.

Another disadvantage with the prior art device is that the clamp secured to the elastic cords opposite the waist strap will only engage a hook suitably located in the area where one desires to exercise. The prior art device thus has the disadvantage that it cannot be adapted to be secured to readily available stationery objects such as a doorknob.

The present invention overcomes the above disadvantages of conventional devices and in particular provides a jogging device having a belt which evenly distributes the resistive pressures over the body's midsection to substantially reduce discomfort or injury due to pinching, pressure points, or skin abrasion. The belt of the present invention also acts to insulate the user's midsection to induce sweating for promoting overall girth reduction.

SUMMARY OF THE INVENTION

The present invention is an improved exercise device comprised essentially of an inner rubber-like body engaging band having substantial width and a substantially inelastic outer reinforcement band secured to one side of the body engaging band. A relatively rubber-like wrap band is attached to one end of the body support belt formed by the inner body engaging band and outer reinforcement material; this wrap band is capable of being stretchably extended from the body support belt to tightly encircle the user's waist in an overlapping relation with the support belt. At least one elastic cord member is attached to the ends of the support belt and means are provided for releasably hooking the elastic cord member to the protruding portion of any convenient anchored object such as a doorknob whereby, when a user wearing the body support belt and wrap band jogs in place against the tension of the elastic cord member, the rubber-like body engaging band evenly distributes pressure over the contacted portion of the body and insulates the user's midsection to induce sweating.

OBJECTS OF THE INVENTION

It is therefore an object of the present invention to provide an improved exercise device having a belt which evenly distributes the resistive pressures over the contacted portion of the user's body.

It is another object of the present invention to provide an improved exercise device which will firmly grip the user's midsection to prevent slippage and skin abrasion.

It is a further object of the present invention to provide an improved exercise device which substantially insulates the contacted portion of the body to induce sweating for promoting reduction of body girth.

It is still another object of the present invention to provide an improved exercise device which can attach to the protruding portion of any readily available and suitably positioned anchored object and which eliminates the need for special hooks or the like.

And it is still a further object of the present invention to provide an improved exercise device having simplified and overall economical construction.

Other objects of the present invention will become apparent from the following specification and claims.

DESCRIPTION OF THE PREFERRED EMBODIMENT

The present invention is an improved exercising device utilized for jogging or running in place against the restoring forces of a stretched elastic cord member. The invention, which has a lightweight and economical construction designed for convenient use in most any indoor or outdoor area, is a unique belt designed to be worn by the user for achieving the above stated objects and advantages of the invention.

Figure 1:
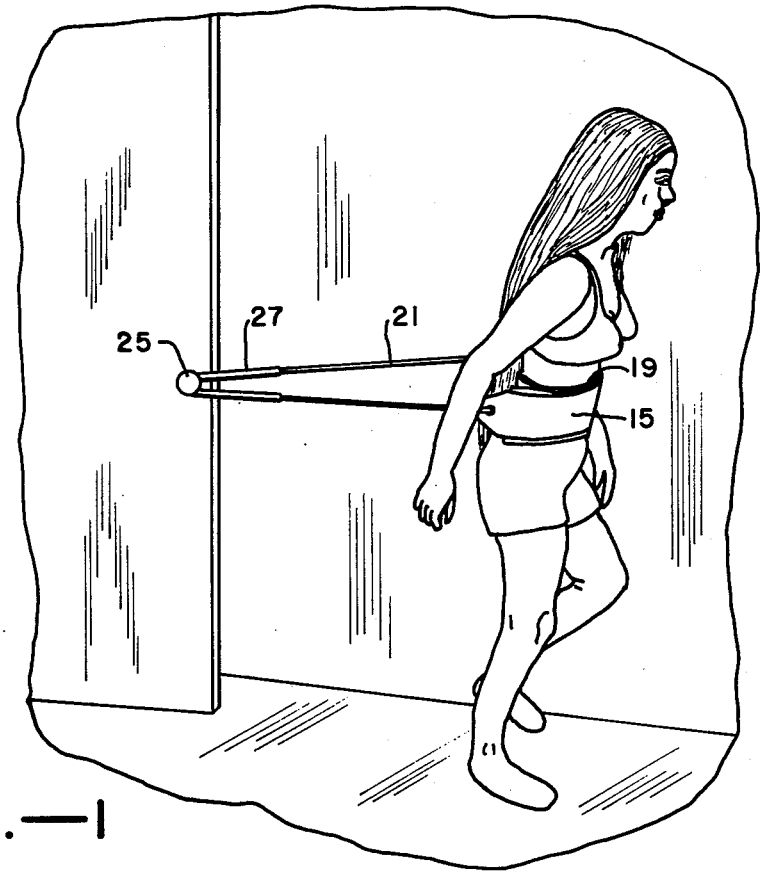
FIG. 1 is a perspective view of an embodiment of the present invention showing its application on a user thereof.
Figure 2:
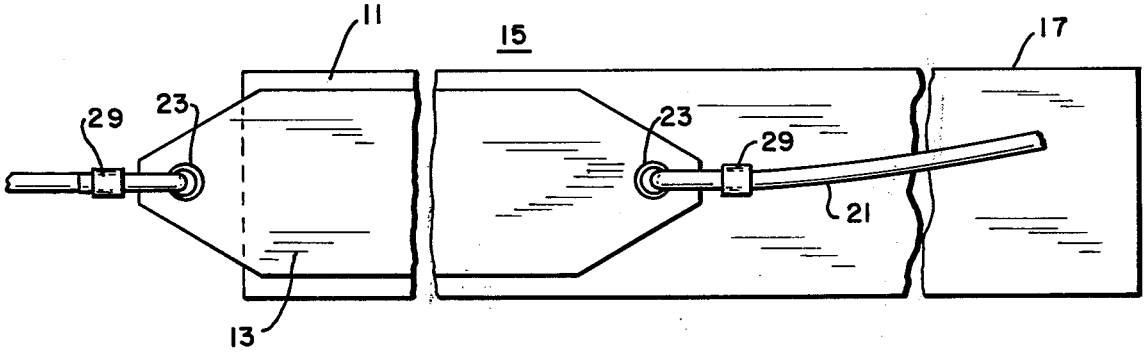
FIG. 2 is a front elevational view.
Figure 3:
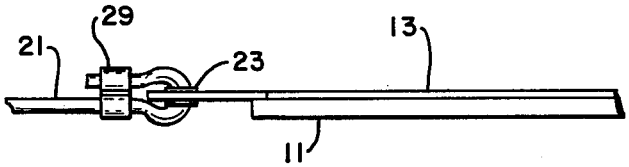
FIG. 3 is a side elevational view.

Referring now to the drawings, rubber-like body engaging band 11 is secured to outer reinforcement material 13 by any suitable attachment means, such as by an industrial strength glue. The outer reinforcement material together with the inner rubber-like body engaging band form body support belt 15 which in use is preferably fitted around the user's midsection as shown in FIG. 1. In order to maximize overall body contact the body engaging band 11 is relatively wide, somewhere between 4 to 12 inches and preferably in the neighborhood of 5 inches. The rubberlike material of this inner body engaging band causes the forces transmitted to it to be evenly distributed over the entire portion of the body contacted by the belt. This eliminates pressure points and reduces the possibility of pinching or belt slippage over the user's skin. As shown in FIG. 2 the reinforcement material 13 would be nearly as wide as the body engaging band in order that the resistive pressures generated during the operation of the device may be evenly transmitted to the maximum portion of the rubber-like material of the inner band. The reinforcement material should be at least 3 to 4 inches and no less than 50% of the width of the body engaging band.

Preferably, the inner body engaging band 11 of body engaging belt 15 would be cut from a thin sheet of neoprene rubber or some other soft, spongy, rubber-like material. The term "rubber-like" is meant to include any synthetic material or form of rubber which possesses the characteristics of rubber and its elasticity. The reinforcement material 13 on the other hand should be of a subtantially inelastic, durable and yet flexible material and preferably a thin plastic for combining durability with light weight.

Figure 4:
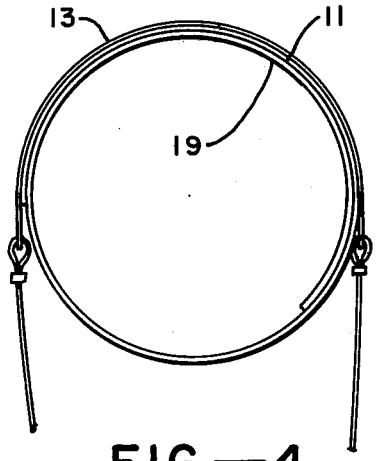
FIG. 4 is a top plan view.

A rubber-like wrap band 17 is attached to and extends from one end of the body support belt 15 and is of a length which when the wrap band is stretched will tightly wrap around the user's midsection in an overlapping relation with the body engaging belt. The overlap of the belt and wrap band is achieved by tucking end portion 19 of wrap band 17 underneath the body engaging belt as shown in FIGS. 1 and 4, whereupon the wrap band will be tightly held around the user's midsection so long as there is tension maintained on the belt. As is clearly seen in FIG. 1, the body engaging belt will typically extend around the stomach of the user with the wrap band tightly contacting the user's sides and back area such that the entire midsection is tightly encircled. In the preferred embodiment, the wrap band would simply be an extension of the body engaging band of the belt 15 such that the body engaging band and wrap band can be cut from a single piece of material. This integral construction also provides the advantage of uniform uninterrupted contact with the body to provide a snug fit and even distribution of pressure.

At least one elastic cord member is provided which is attached to the body engaging belt and which releasably attached to the protruding portion of any suitable anchored object such as a doorknob. Thus, a user wearing the belt as shown in FIG. 1 can stretch the cord member by moving away from the fixed end of the cord. Preferably, only a single elastic cord member 21 is used and is attached to the ends of the reinforcement band so as to be extendable therefrom in a large single or folded loop. In FIG. 1 the stretched extension cord is shown looped around doorknob 25. A plastic sheath 27 is fitted on the elastic cord member generally in the center portion thereof, for the purpose of protecting the cord member and also for providing a smooth surface for sliding on the doorknob stem such that the two extended segments of the cord member can be readily equalized in length.

As shown in FIG. 2, cord member 21 is secured to the reinforcing band 13 of the body engaging belt 15 by looping the ends of the cord member through metal eyelets 23 and securing the loop in a closed position by clamps 29. Eyelets 23 and clamps 29 provide a secure and durable yet simple and economical fastening means for witnstanding the forces generated by the stretched elastic cord member pulling against the reinforcement band of the body engaging belt.

The present invention is an improved exercise device of simple construction which provides a belt portion which contacts a substantial portion of the user's midsection when compared with conventional devices and which has the particular advantage of evenly distributing the resistive forces over the contracted portion of the user's body. This construction thus eliminates points of extreme pressure where the belt contacts the body and in addition insulates the midsection to induce sweating which promotes the reduction of body girth. The present invention also has an advantage over conventional devices in that it can be readily attached to any available and suitably positioned anchored object in the exercise area thereby eliminating the need for specially provided attaching mechanisms.

Although the present invention has been described above in considerable detail, it is not intended that it be limited to such detail, except as may be necessitated by the appended claims.

What is claimed is:

1. An improved exercising device comprising a relatively wide elastic body engaging band, a substantially inelastic reinforcement material secured to one side of said body engaging band forming a body support belt, a relatively wide elastic wrap band means secured to and extending substantially beyond one end of the body support belt whereby said wrap band means may be stretched to tightly encircle the user's body in overlapped relation with said support belt on the inside thereof between the user and the belt to evenly distribute the pressure developed during an exercise program, over the contacted portion of the body and to insulate said body contacted portion, at least one elastic cord member attached to the reinforcement material of said body support belt, and means for releasably hooking the end of said elastic cord member to an anchored object such as the knob of a door whereby a user wearing said body support belt around the waist or midsection can jog in place against the tension of said elastic cord member.

2. The improved exercising device of claim 1 wherein said elastic cord member includes two ends which are attached to the two ends of the reinforcement material of said body support belt and said elastic cord member is extendable therefrom in a loop capable of being placed around the protruding portion of said anchored object and held thereon by tension when said cord member is stretched.

3. The improved exercising device of claim 2 wherein said wrap band means is formed by the integral extension of the body engaging band beyond one end of said reinforcement material.

4. The improved exercising device of claim 1 wherein said rubber-like body engaging and wrap band means has a width of between 4 and 12 inches, and said reinforcement material has a width of at leat 3 inches or 50% of the width of said body engaging and wrap band whichever is greater.

5. An improved exercising device comprising an elastic body engaging band, a substantially inelastic reinforcement material secured to one side of said body engaging band forming a body support belt, an elastic wrap band means formed by the extension of the body engaging band beyond one end of said reinforcement material on the inside thereof, said wrap band means being secured to and extending substantially beyond the body support belt to tightly encircle the user's waist in overlapped relation with said body support belt on the inside thereof, immediately adjacent to the body of a user said body engaging band and wrap band extension having a width of between 4 and 12 inches, and said reinforcement material having a width of at least 3 inches or 50% of the width of said body engaging band whichever is greater, and an elastic cord member the two ends of which are attached to the two ends of the reinforcement material of said body support belt, said elastic cord member being extendable therefrom in a loop capable of being placed around the protruding portion of an anchored object such as a doorknob and held thereon by tension when said elastic cord member is stretched by a user wearing said body support belt around the waist while jogging in place against the tension of said elastic cord member whereby said elastic body engaging band and its wrap band extension evenly distribute the pressure over the contacted portion of the body and insulate the user's midsection to induce sweating.

* * * * *